US009856682B1

(12) United States Patent
Cook

(10) Patent No.: US 9,856,682 B1
(45) Date of Patent: Jan. 2, 2018

(54) CLASSROOM ACCESS RESTRAINT

(71) Applicant: Shari Cook, Prairie, MO (US)

(72) Inventor: Shari Cook, Prairie, MO (US)

( * ) Notice: Subject to any disclaimer, the term of this patent is extended or adjusted under 35 U.S.C. 154(b) by 0 days.

(21) Appl. No.: 14/996,328

(22) Filed: Jan. 15, 2016

(51) Int. Cl.
*E05C 17/54* (2006.01)
*E05C 17/46* (2006.01)

(52) U.S. Cl.
CPC ..... *E05C 17/54* (2013.01); *E05C 17/46* (2013.01); *Y10T 16/61* (2015.01)

(58) Field of Classification Search
CPC ..... E05C 17/46; E05C 17/48; E05C 17/50; E05C 17/505; E05C 17/52; E05C 17/54; E05C 17/44; E05C 17/443; E05C 17/446; E05C 19/003; E05C 19/005; E05C 19/18; E05C 19/184; E05C 19/188
See application file for complete search history.

(56) References Cited

U.S. PATENT DOCUMENTS 463,361 A * 11/1891 Frazier ..... E05B 67/383 70/14
4,198,088 A * 4/1980 Tochihara ..... E05C 19/18 292/288
4,330,146 A * 5/1982 Sessions, Jr. ..... E05C 19/182 292/258
4,585,259 A * 4/1986 Vidas ..... E05C 17/54 16/82
4,653,140 A * 3/1987 Hudec ..... E05C 17/54 16/82
5,291,760 A * 3/1994 Schrader ..... E05C 19/18 292/288
6,120,072 A * 9/2000 Benedict ..... E05C 17/443 292/338
6,378,917 B1 4/2002 Jones
6,604,764 B2 * 8/2003 Zemzik ..... E05C 19/188 292/288
7,065,830 B2 * 6/2006 Bushey ..... E05C 17/443 16/82
7,637,130 B2 * 12/2009 Carr ..... E05B 47/00 292/259 R
7,770,420 B2 * 8/2010 Carr ..... E05C 19/003 292/259 R
8,251,412 B2 * 8/2012 Ploskunak ..... E05C 19/184 292/263
8,469,410 B2 * 6/2013 Wood ..... E05C 7/00 292/288
8,510,994 B2 * 8/2013 Scott ..... E05B 9/08 292/289
8,544,899 B2 * 10/2013 Hertrich ..... E05B 65/0014 292/195
8,764,074 B2 * 7/2014 Ploskunak ..... E05C 1/00 292/164
8,899,639 B2 * 12/2014 Ploskunak ..... E05C 19/184 292/288
9,010,254 B1 4/2015 Kyler
9,145,729 B2 9/2015 Spransy
(Continued)

*Primary Examiner* — Jeffrey O Brien
(74) *Attorney, Agent, or Firm* — Haugen Law Firm PLLP

(57) ABSTRACT

An apparatus and method for efficiently restricting access to a classroom is described. The apparatus is particularly well suited for a school teacher needing to quickly barricade the classroom door and restrict access into the classroom. The apparatus of the present invention is efficiently slid under the door and tightened to the door and jamb to restrain the opening of the door.

10 Claims, 5 Drawing Sheets

(56) References Cited

U.S. PATENT DOCUMENTS

| | | | | |
|---|---|---|---|---|
| 9,279,278 | B2 * | 3/2016 | Ploskunak | E05C 19/184 |
| 9,500,315 | B2 * | 11/2016 | Ajello | F16M 13/022 |
| 9,518,421 | B2 * | 12/2016 | Cushwa, Jr. | E06B 5/10 |
| 2008/0116339 | A1 * | 5/2008 | Simonsen | A47K 10/12 248/214 |
| 2014/0175814 | A1 | 6/2014 | Holsopple | |
| 2014/0300114 | A1 | 10/2014 | Atkinson, Jr. | |
| 2014/0306464 | A1 * | 10/2014 | Lowe | E05C 19/003 292/260 |
| 2014/0306466 | A1 * | 10/2014 | Couturier | E05C 19/184 292/338 |
| 2014/0312634 | A1 * | 10/2014 | Cushwa, Jr. | E06B 5/10 292/340 |
| 2015/0048631 | A1 * | 2/2015 | Ploskunak | E05C 19/184 292/258 |
| 2015/0137534 | A1 * | 5/2015 | Brunke | E05C 19/003 292/295 |
| 2015/0184436 | A1 | 7/2015 | Caruso | |
| 2015/0191949 | A1 * | 7/2015 | Wilson | E05C 19/003 292/259 R |
| 2015/0284982 | A1 * | 10/2015 | Nietzel | E05F 3/227 292/341.14 |
| 2016/0230435 | A1 * | 8/2016 | Cheever | E05C 17/54 |

* cited by examiner

CLASSROOM ACCESS RESTRAINT

CROSS-REFERENCE TO RELATED APPLICATIONS

Not Applicable.

FEDERAL SPONSORSHIP

Not Applicable

JOINT RESEARCH AGREEMENT

Not Applicable

TECHNICAL FIELD

This invention pertains generally to door barricades. More particularly, the invention pertains to a device that quickly and easily installs on a classroom door allowing a school teacher to quickly restrict access into a classroom. The restraint device is particularly well suited for restricting the opening of a classroom door that does not have conventional door handle locks.

BACKGROUND

Over the years, classrooms have been constructed having doors to isolate the classroom from adjacent hallways and other portion of the building. At times there has been a desire to avoid door handles having the ability to lock the handle from the inside of the classroom. Further, previously it was desirable to make the classrooms accessible from the hallway to eliminate the possibility of restricting access into the classroom. Thus, many school building walls and doors have been constructed to achieve these desires. However, recent social events has generated a need to allow teachers the ability to barricade and restrict access into their classrooms. Prior devices to barricade a classroom door include limitations that do not allow for the rapid placement and removal of the barricade device. For example, prior attempts have been made to barricade a classroom door without a door knob locking mechanism, however these devices have required mounting of the device onto a portion of the door or doorjamb. Other attempts have required structural modifications to the floor or door jamb. The shortcomings of other prior classroom door restraints also increases the likelihood that an intruder could overcome the restraint through force or easy removal.

SUMMARY

Embodiments according to aspects of the invention allow a school teacher to expeditiously restrict access into a classroom in the event of a lockdown or other impending need to restrict entry into the classroom. Embodiments of the door barricade apparatus of the present invention include a base, extensions and a door pressing member. The base has a first end including a door engaging member extending vertically from the base, a mid-section of the base has a thickness dimension less than a spacing between a floor and a bottom edge of a door, and a support section of the base terminates at a second end of the base that opposes the first end of the base. The extensions extend tangentially outward from the support section of the base and are adapted to engage a door jamb and adjacent wall section. The pressing member is coupled to the support section and is adaptable to apply a force to the door to thereby sandwich the door between the door engaging member and a portion of the pressing member.

Embodiments of the door barricade apparatus in accordance with aspects of the invention further include a support member through which a threaded rod rotates. The threaded rod has a first end aligned towards the door engaging member and has a second end extending in a direction opposite the door engaging member and terminating in a knob. The first end of the threaded rod may further include a pliant stop coupled to the first end of the threaded rod.

Expeditious barricading of a classroom door may be accomplished in accordance with the present invention. The method of barricading a classroom door and restricting the door from rotating out away from the classroom can be accomplished by positioning a door barricade apparatus of the present invention in alignment with a door, doorjamb, and adjacent wall section and then engaging the door barricade apparatus with the door. In this manner a teacher may quickly and expeditiously restrict entry into the classroom.

The method includes using a door barricade apparatus comprised of a base, extension members and a pressing member. The base has a first end including a door engaging member extending vertically from the base, a mid-section of the base having a thickness dimension less than a spacing between a floor and a bottom edge of the door, and a support section terminating at a second end of the base that opposes the first end of the base. The extensions extending tangentially outward from the support section of the base and are adapted to engage the door jamb and the adjacent wall section. The pressing member couples to the support section and is adaptable to apply a force to the door to thereby sandwich the door between the door engaging member and a portion of the pressing member. The pressing member includes a support member through which a threaded rod rotates; the threaded rod having a first end aligned towards the door engaging member and having a second end extending in a direction opposite the door engaging member and terminating in a knob. The first end of the threaded rod further includes a pliant stop coupled to the first end of the threaded rod. The method may further include the step of engaging the pliant stop against the door. The step of positioning the door barricade apparatus may further include aligning at least one of the extensions to overlap the door jamb and wall.

The accompanying drawings, which are incorporated in and constitute a portion of this specification, illustrate embodiments of the invention and, together with the detailed description, serve to further explain the invention. The embodiments illustrated herein are presently preferred; however, it should be understood, that the invention is not limited to the precise arrangements and instrumentalities shown. For a fuller understanding of the nature and advantages of the invention, reference should be made to the detailed description in conjunction with the accompanying drawings.

DESCRIPTION OF THE DRAWINGS

In the various figures, which are not necessarily drawn to scale, like numerals throughout the figures identify substantially similar components.

DETAILED DESCRIPTION

Figure 1:
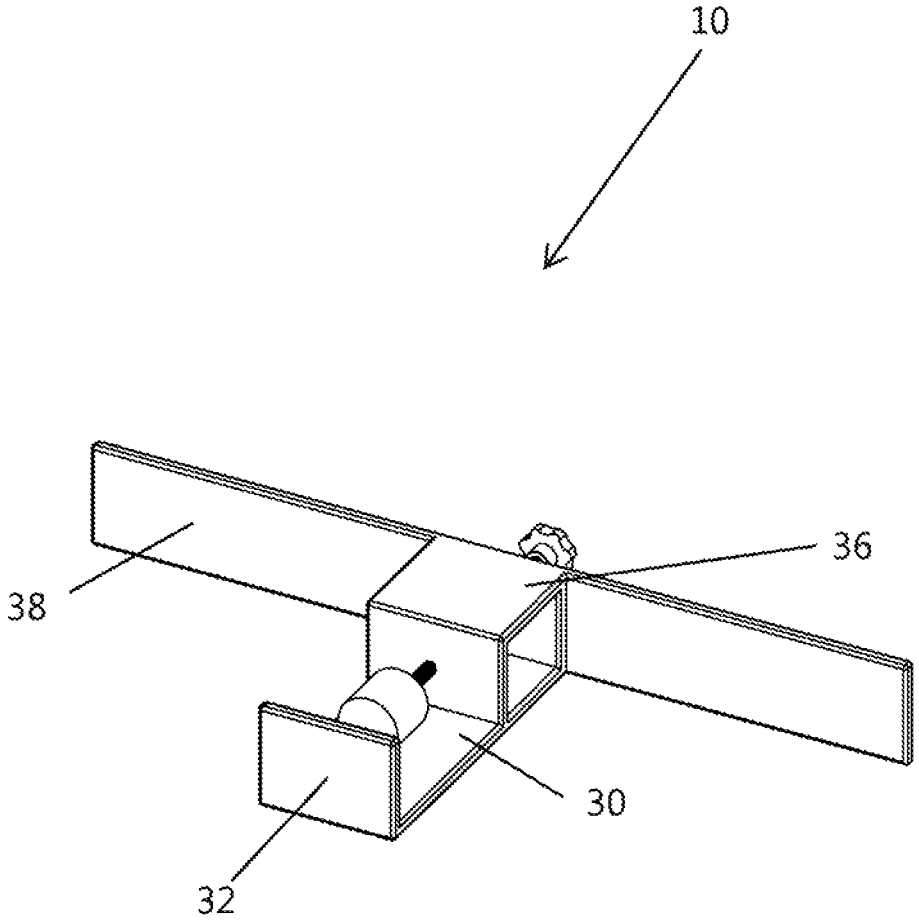
FIG. 1 is a front perspective view of an embodiment of a door restraint apparatus of the present invention.

The following description provides detail of various embodiments of the invention, one or more examples of which are set forth below. Each of these embodiments are provided by way of explanation of the invention, and not intended to be a limitation of the invention. Further, those skilled in the art will appreciate that various modifications and variations may be made in the present invention without departing from the scope or spirit of the invention. By way of example, those skilled in the art will recognize that features illustrated or described as part of one embodiment, may be used in another embodiment to yield a still further embodiment. Thus, it is intended that the present invention also cover such modifications and variations that come within the scope of the appended claims and their equivalents.

The apparatus of the present invention is particularly well suited for quickly restricting access into a classroom. The apparatus may be installed and removed simply and does not require modification to an existing classroom door or door-jamb. Further, those skilled in the art will appreciate that the door barricade apparatus in accordance with the present invention may withstand significant force attempts to overcome the restraining apparatus. The door restraint 10 of the present invention generally includes a base 30, door engaging member 32, door pressing or clamping member 40, and door jamb engaging extensions 38.

Figure 2:
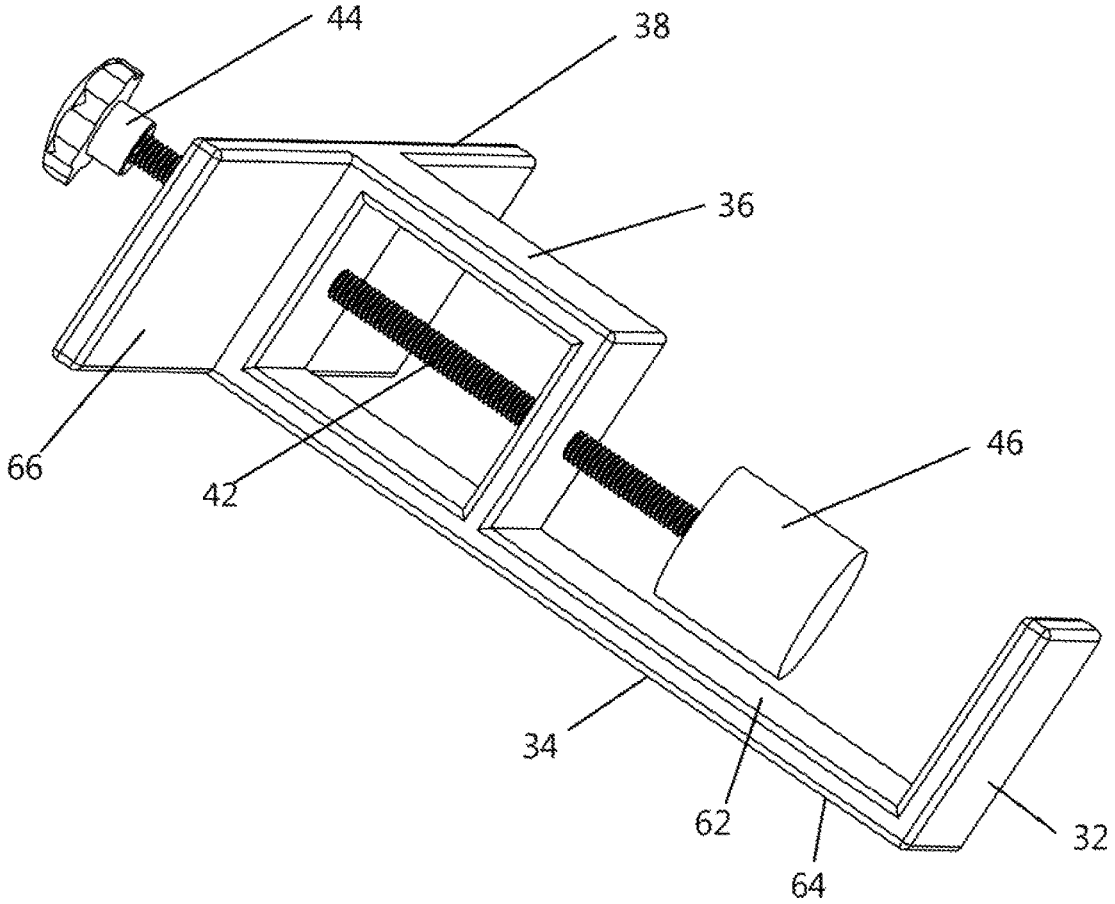
FIG. 2 is a left side perspective view of an embodiment of a door restraint apparatus of the present invention.
Figure 3:
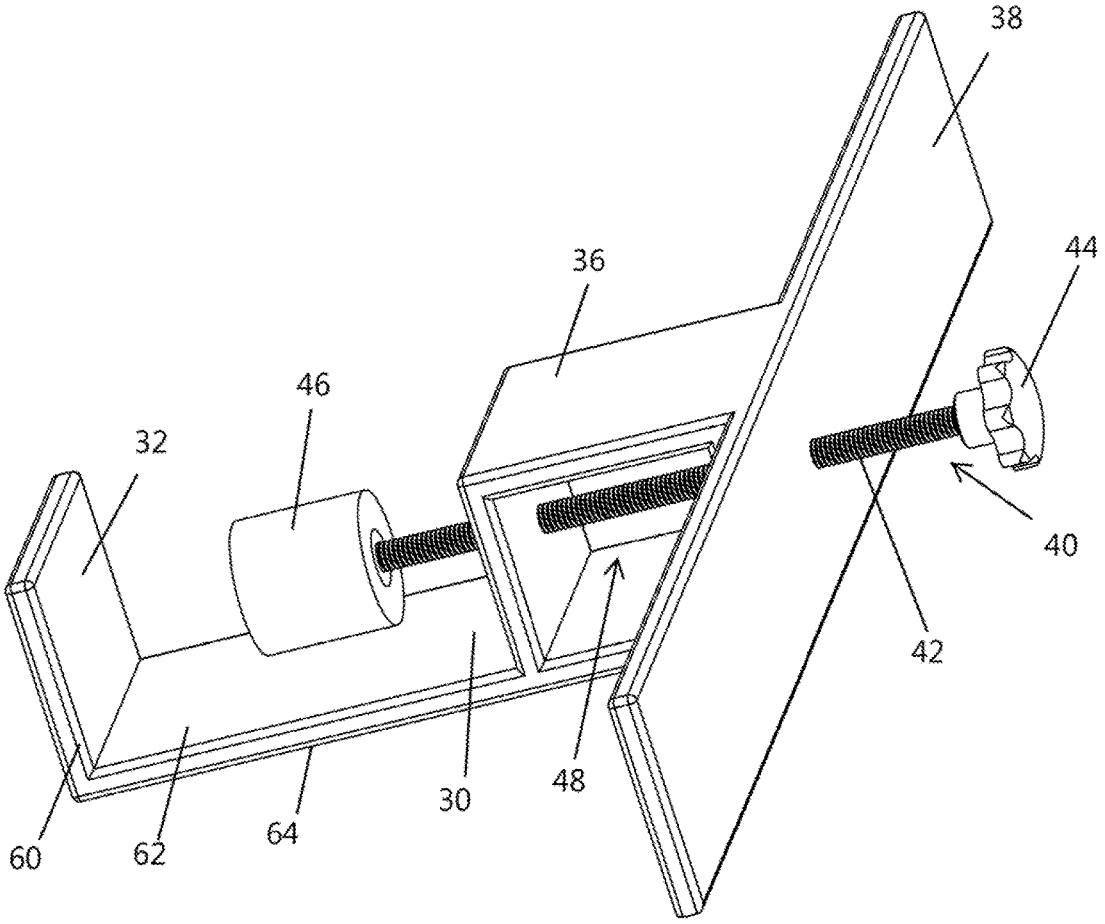
FIG. 3 is a right side perspective view of an embodiment of a door restraint apparatus of the present invention.

With reference to FIGS. 1-3, embodiments according to aspects of the invention will be described in conjunction with the door restraint 10. The base 30 has a first end including the door engaging member 32 extending vertically from the base 30, a mid-section 34 of the base having a thickness dimension less than a spacing between a floor and a bottom edge of a door 14, and a support section 36 terminating at a second end of the base 30. The support section 36 opposes the first end of the base 30 and includes extensions 38 extending tangentially outward from the support section 36 of the base 30. The extensions 38 are symmetric and adapted to engage either side of a door jamb 16 and adjacent wall section 18; independent of the direction the door swings out from the door jamb 16.

The pressing member 40 is coupled to the support section 36 and adaptable to apply a force to the door 14 to thereby fix the door restraint 10 in place and sandwich the door 14 between the door engaging member 32 and a portion of the pressing member 40. In an embodiment of the invention the pressing member 40 includes a support member defining the support section 36 of the base. A threaded rod 42 extends through the support member in threaded holes to allow rotation of the rod 42. Hex nuts may be position on either side of the support member to restrict rotation of the threaded rod 42. The threaded rod has a first end aligned towards the door engaging member 32 and has a second end extending in a direction opposite the door engaging member and terminating in a knob 44. The first end of the threaded rod 42 may further include a pliant stop or rubber tip 46 coupled to the first end of the threaded rod 42. Those skilled in the art will appreciate that in order to reduce the weight of the door restraint 10, while maintaining the rigidity of the apparatus, the support member may have a hollow section 48 extending from one side to the other. Also, the support member and pressing member could be constructed similar to a toggle clamp and mounted to the base 30. Further, in embodiments of the invention felt 60 may be applied to the door engaging member 32, felt 62 may be applied to a top side of the mid-section 34, felt 64 may be applied to the bottom of base 30, and felt 66 may be applied to the door engaging side of the extensions 38.

Figure 4:
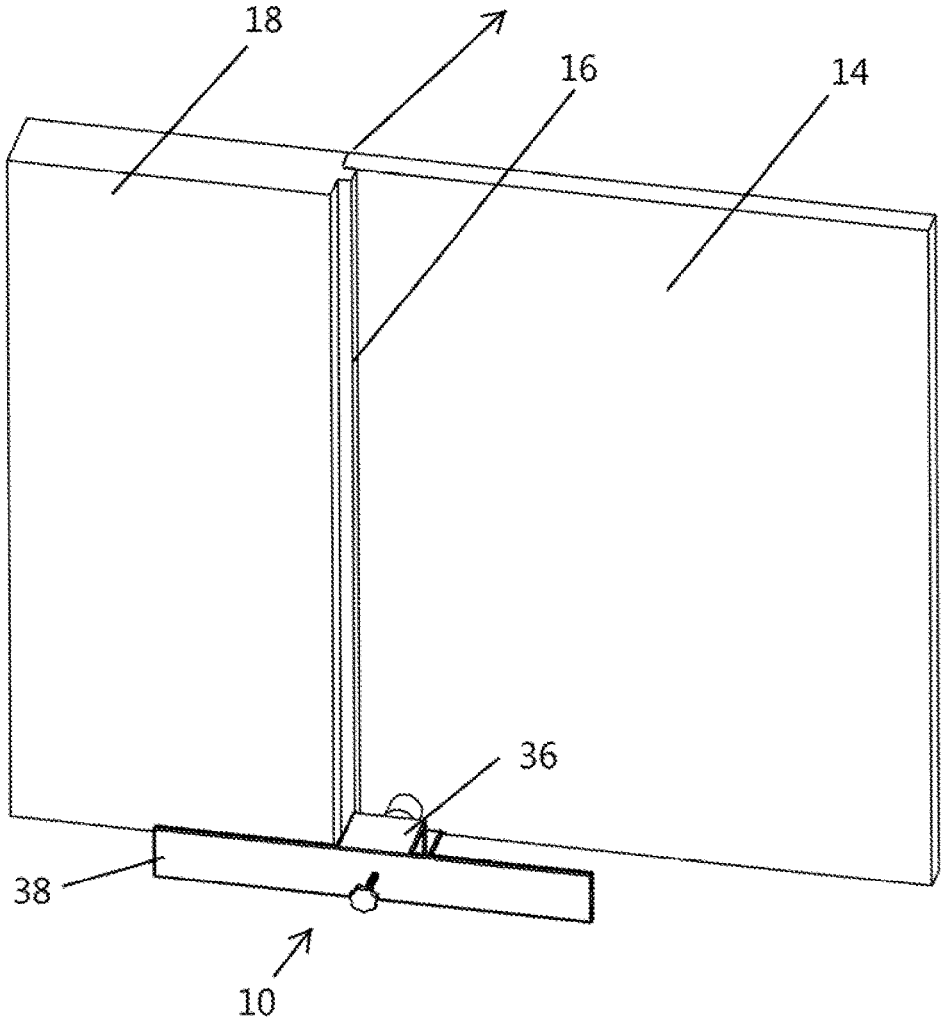
FIG. 4 is a partial perspective view of an embodiment of a door restraint apparatus of the present invention shown positioned and oriented to a door and door jamb inside a classroom.
Figure 5:
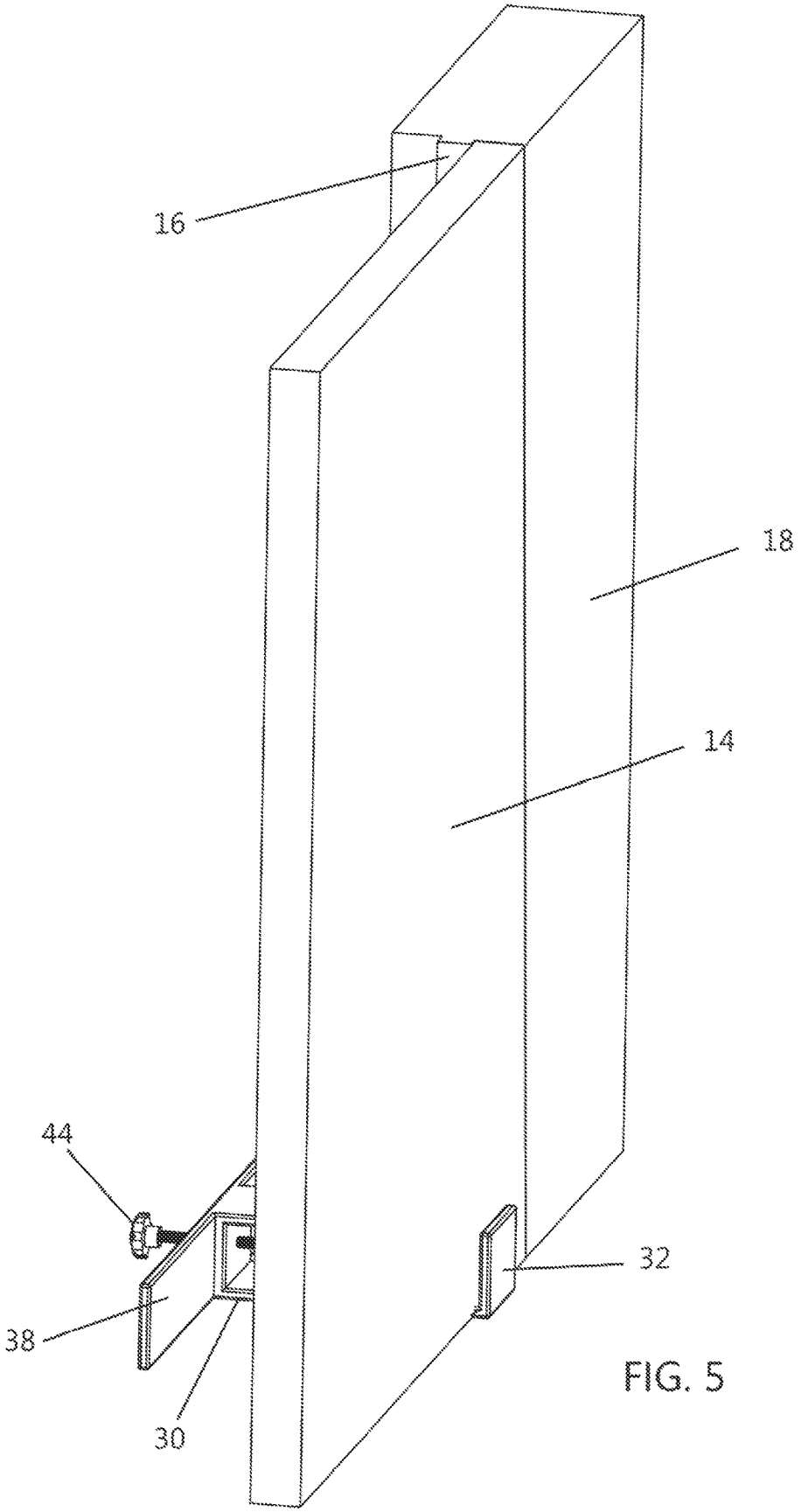
FIG. 5 is a partial perspective view of an embodiment of a door restraint apparatus of the type shown in FIG. 4 positioned and oriented to a door and door jamb and shown from outside the classroom.

Having described the constructional features of the door restraint 10 of the present invention, it's use will be described in greater detail. With reference to FIGS. 4 and 5 door 14 is pivoted on hinges far enough away from the door jamb 16 to allow the mid-section 34 of the base 30 to be slid under the door 14 such that the door engaging member 32 is positioned on the outside of the door and the pressing member 40 is adjacent the inside of the door. The door is then closed and the door restraint 10 is slid towards the door jamb 16 so that the extension 38 extends past the door jamb and a portion of the wall section 18. Once the door restraint is positioned, the knob 44 is turned in a direction so that the threaded rod 42 rotates closer to the door 14 and until the pliant stop 46 firmly engages with the door 10. When an attempt is made to open the door, the extension engages the jamb 16 and wall section 18 and is capable of withstanding significant outward forces against the door.

These and various other aspects and features of the invention are described with the intent to be illustrative, and not restrictive. This invention has been described herein with detail in order to comply with the patent statutes and to provide those skilled in the art with information needed to apply the novel principles and to construct and use such specialized components as are required. It is to be understood, however, that the invention can be carried out by specifically different constructions, and that various modifications, both as to the construction and operating procedures, can be accomplished without departing from the scope of the invention. Further, in the appended claims, the transitional terms comprising and including are used in the open ended sense in that elements in addition to those enumerated may also be present. Other examples will be apparent to those of skill in the art upon reviewing this document.

What is claimed is:

1. A door barricade apparatus, said apparatus comprising:

a base having a first end including a door engaging member extending vertically from the base, a mid-section of the base having a thickness dimension less than a spacing between a floor and a bottom edge of a door, and a unitary support member extending vertically from the base wherein said support member has a front plate and a back plate spaced apart from one another, said front plate of said unitary support member being spaced apart and opposing the door engaging member and said back plate of said unitary support member terminating at a second end of the base that opposes the first end of the base, and further wherein a top of the front plate is interconnected with a top of the back plate of the unitary support member via a top plate;

a first fixed extension extending tangentially outward from the back plate of said unitary support member, said first extension adapted to engage a first side of a doorjamb and adjacent wall section;

a second fixed extension extending tangentially outward from the back plate of said unitary support member and extending outwardly in a direction opposite the first extension and wherein said second extension is adapted to engage a second side of the door jamb and adjacent wall section that opposes the first side of the door jamb; and a pressing member coupled to the support member, said pressing member having a first end extending outward towards said door engaging member from the front plate of said support member and having a second end extending outward and away from the back plate of said support member, said pressing member being adaptable to apply a force to the door to thereby sandwich the door between the door engaging member and a portion of the first end of the pressing member.

2. The door barricade apparatus as recited in claim 1, wherein said pressing member includes a threaded rod rotatably coupled to said support member, further wherein said second end of said pressing member terminates in a knob.

3. The door barricade apparatus as recited in claim 2, wherein the first end of the pressing member further includes a pliant stop coupled to the first end of the pressing member.

4. The door barricade as recited in claim 1, further including felt on an inner surface of the door engaging member.

5. The door barricade apparatus as recited in claim 1, further including felt on an inner portion of the mid-section of the base.

6. The door barricade apparatus as recited in claim 1, further including felt on an underside of the base.

7. The door barricade apparatus as recited in claim 3, wherein said support member has a hollow section extending between the front plate and the back plate of the support member.

8. A method of barricading a classroom door from rotating out away from a classroom and to restrict entry into the classroom, said method including the steps of:

positioning a door barricade apparatus in alignment with a door, a doorjamb, and an adjacent wall section, said door barricade apparatus including:

a base having a first end including a door engaging member extending vertically from the base, a mid-section of the base having a thickness dimension less than a spacing between a floor and a bottom edge of a door, and a unitary support member extending vertically from the base wherein said support member has a front plate and a back plate spaced apart from one another, said front plate of said unitary support member being spaced apart and opposing the door engaging member and said back plate of said unitary support member terminating at a second end of the base that opposes the first end of the base, and further wherein a top of the front plate is interconnected with a top of the back plate of the unitary support member via a top plate;

a first fixed extension extending tangentially outward from the back plate of said unitary support member, said first extension adapted to engage a first side of a doorjamb and adjacent wall section;

a second fixed extension extending tangentially outward from the back plate of said unitary support member and extending outwardly in a direction opposite the first extension and wherein said second extension is adapted to engage a second side of the door jamb and adjacent wall section that opposes the first side of the door jamb; and a pressing member coupled to the support member, said pressing member having a first end extending outward towards said door engaging member from the front plate of said support member and having a second end extending outward and away from the back plate of said support member, said pressing member being adaptable to apply a force to the door to thereby sandwich the door between the door engaging member and a portion of the first end of the pressing member.

9. The method as recited in claim 8, wherein the first end of the pressing member further includes a pliant stop, and further including the step of engaging the pliant stop against the door.

10. The method as recited in claim 8, wherein the step of positioning the door barricade apparatus further includes aligning the first or second extension to overlap an adjacent portion of the door jamb and wall.

* * * * *